US012252831B2

(12) United States Patent
Horn et al.

(10) Patent No.: US 12,252,831 B2
(45) Date of Patent: Mar. 18, 2025

(54) WASHING MACHINE APPLIANCE AND METHODS FOR VARYING DISPENSING BASED ON WATER HARDNESS

(71) Applicant: Haier US Appliance Solutions, Inc., Wilmington, DE (US)

(72) Inventors: Austin Horn, Independence, KY (US); Noushin Mir, Louisville, KY (US); Hyeonsoo Moon, Seoul (KR); Wonmyung Seo, Gyeonggi-do (KR); Khalid Jamal Mashal, Louisville, KY (US); Je Kwon Yoon, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 257 days.

(21) Appl. No.: 17/881,705

(22) Filed: Aug. 5, 2022

(65) Prior Publication Data

US 2024/0044065 A1 Feb. 8, 2024

(51) Int. Cl.

| | |
|---|---|
| ***D06F 33/37*** | (2020.01) |
| ***D06F 34/22*** | (2020.01) |
| ***D06F 39/02*** | (2006.01) |
| *D06F 103/20* | (2020.01) |
| *D06F 103/60* | (2020.01) |
| *D06F 105/42* | (2020.01) |

(52) U.S. Cl.

CPC ..... *D06F 33/37* (2020.02); *D06F 34/22* (2020.02); *D06F 39/02* (2013.01); *D06F 2103/20* (2020.02); *D06F 2103/60* (2020.02); *D06F 2105/42* (2020.02)

(58) Field of Classification Search

CPC ..... D06F 33/37; D06F 34/05; D06F 34/22; D06F 39/02; D06F 39/022; D06F 2103/20; D06F 2103/22; D06F 2103/60; D06F 2105/42

See application file for complete search history.

(56) References Cited

U.S. PATENT DOCUMENTS

| | | | |
|---|---|---|---|
| 7,709,265 | B2 | 5/2010 | Chan et al. |
| 8,015,645 | B2 | 9/2011 | Park et al. |
| 8,424,345 | B2 | 4/2013 | Park et al. |

(Continued)

FOREIGN PATENT DOCUMENTS

| | | | |
|---|---|---|---|
| CN | 109811511 A | 5/2019 | |
| EP | 3228741 A1 * | 10/2017 | ..... D06F 39/007 |

*Primary Examiner* — Joseph L. Perrin

(74) *Attorney, Agent, or Firm* — Dority & Manning, P.A.

(57) ABSTRACT

A washing machine appliance may include a wash tub, a wash basket, a dispensing assembly, a water hardness sensor, a camera assembly, and a controller. The wash tub may be positioned within a cabinet. The water hardness sensor may be mounted in fluid communication with the wash tub. The camera assembly may be spaced apart from the wash tub. The controller may be communicatively coupled to the water hardness sensor and the camera assembly. The controller may be configured to direct a washing operation. The washing operation may include identifying a wash additive provided to the washing machine appliance, determining a water hardness level of water provided to the washing machine appliance, determining a cycle additive volume based on the identified wash additive and the determined water hardness level, and dispensing the determined cycle additive volume within the wash tub.

10 Claims, 6 Drawing Sheets

(56) References Cited

U.S. PATENT DOCUMENTS

| | | | | |
|---|---|---|---|---|
| 11,071,435 | B2 | 7/2021 | Kessler et al. | |
| 2001/0049846 | A1* | 12/2001 | Guzzi | D06F 34/22 68/17 R |
| 2006/0216217 | A1* | 9/2006 | Chan | G01N 33/1853 422/218 |
| 2019/0003104 | A1 | 1/2019 | Shu et al. | |
| 2020/0002874 | A1 | 1/2020 | Kessler et al. | |
| 2021/0198834 | A1* | 7/2021 | Hammond | D06F 25/00 |
| 2021/0214875 | A1 | 7/2021 | Choi | |
| 2022/0333287 | A1* | 10/2022 | Zattin | D06F 39/02 |

* cited by examiner

WASHING MACHINE APPLIANCE AND METHODS FOR VARYING DISPENSING BASED ON WATER HARDNESS

FIELD OF THE INVENTION

The present subject matter relates generally to washing machine appliance, and more particularly to appliances and methods with smart wash additive dispense capability.

BACKGROUND OF THE INVENTION

Washing machine appliances can use a variety of wash additives (e.g., a detergent, fabric softener, or bleach) in addition to water to assist with washing and rinsing a load of articles. For example, detergents or stain removers may be added during wash and prewash cycles of washing machine appliances. As another example, fabric softeners may be added during rinse cycles of washing machine appliances. Wash additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

Dispensing the proper volume of wash additives has been challenging, for instance, due to variations in concentration or viscosity in wash additives on the market. Different types of detergents often recommend wildly different volumes for cleaning similar load sizes or water volumes. Moreover, the performance of certain wash additives can be significantly altered by changes in water hardness. Unfortunately, water hardness levels can vary greatly between countries, states, counties, cities, or localities.

Conventionally, wash additives, such as detergent, have been dispensed based on an "activation time" or "on time" of a component of the washing machine appliance, such as e.g., a dosing pump or a water inlet valve. Despite the wide ranging differences between different wash additives and the water hardness levels supplied to different locations, the "activation time" is generally not modified or altered. Accordingly, many appliances suffer from poor dispensing performance or may require high levels of user intervention to improve performance.

Accordingly, washing machine appliances and methods for operating such washing machine appliances that address one or more of the challenges noted above would be useful. In particular, it may be advantageous to provide an appliance or method that can account for changes in wash additives or water.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include identifying a wash additive provided to the washing machine appliance and determining a water hardness level of water provided to the washing machine appliance. The method may also include determining a cycle additive volume based on the identified wash additive and the determined water hardness level. The method may further include dispensing the determined cycle additive volume within the wash tub.

In another exemplary aspect of the present disclosure, a washing machine appliance is provided. The washing machine appliance may include a wash tub, a wash basket, a dispensing assembly, a water hardness sensor, a camera assembly, and a controller. The wash tub may be positioned within a cabinet. The wash basket may be rotatably mounted within the wash tub and defining a wash chamber configured for receiving a load of clothes. The dispensing assembly may be configured to selectively dispense a flow of wash fluid through a discharge nozzle into the wash tub. The water hardness sensor may be mounted in fluid communication with the wash tub. The camera assembly may be spaced apart from the wash tub. The controller may be communicatively coupled to the water hardness sensor and the camera assembly. The controller may be configured to direct a washing operation. The washing operation may include identifying a wash additive provided to the washing machine appliance, determining a water hardness level of water provided to the washing machine appliance, determining a cycle additive volume based on the identified wash additive and the determined water hardness level, and dispensing the determined cycle additive volume within the wash tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
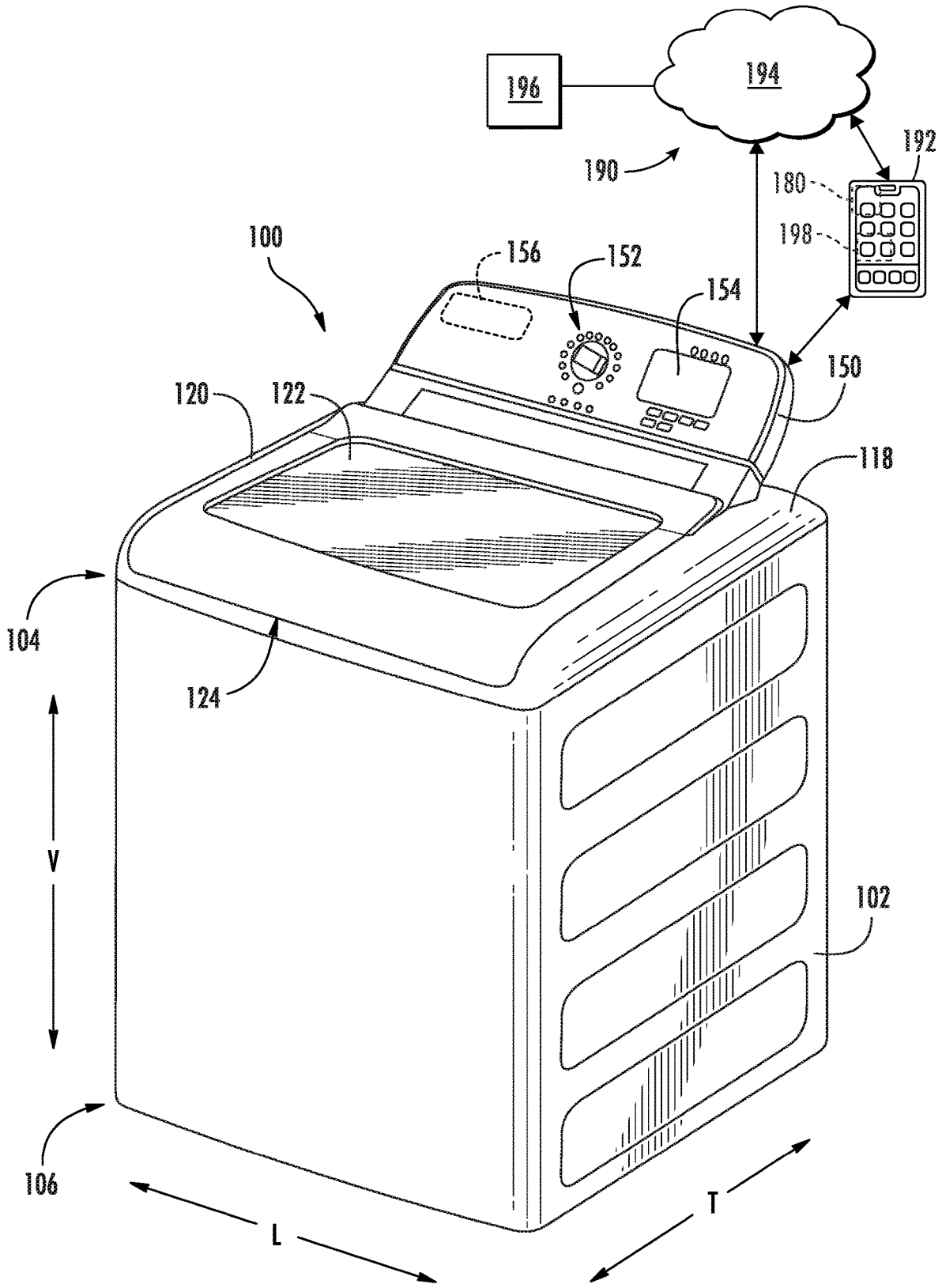
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
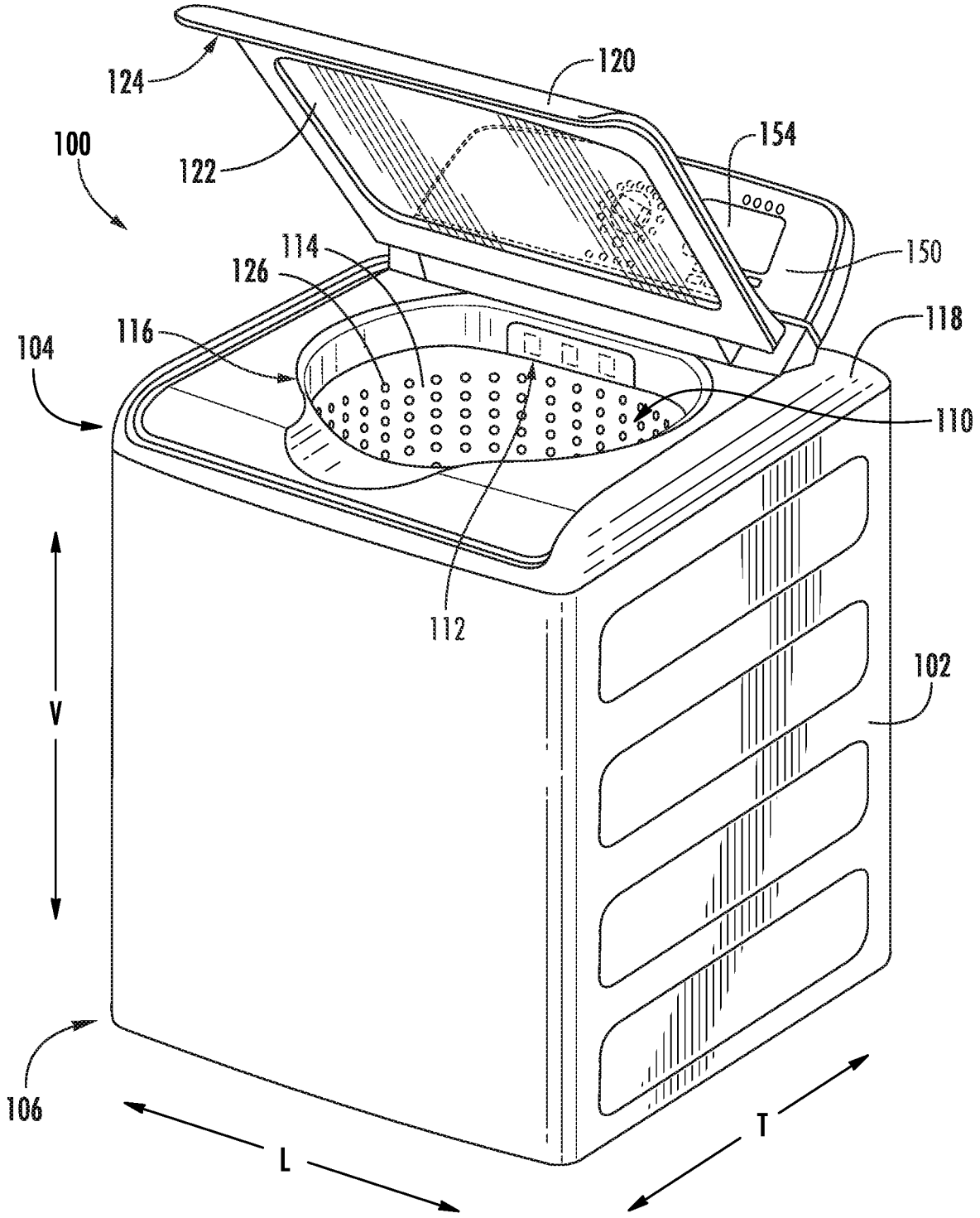
FIG. 2 provides a perspective view of the exemplary washing machine appliance of FIG. 1 with the door of the exemplary washing machine appliance shown in an open position.
Figure 3:
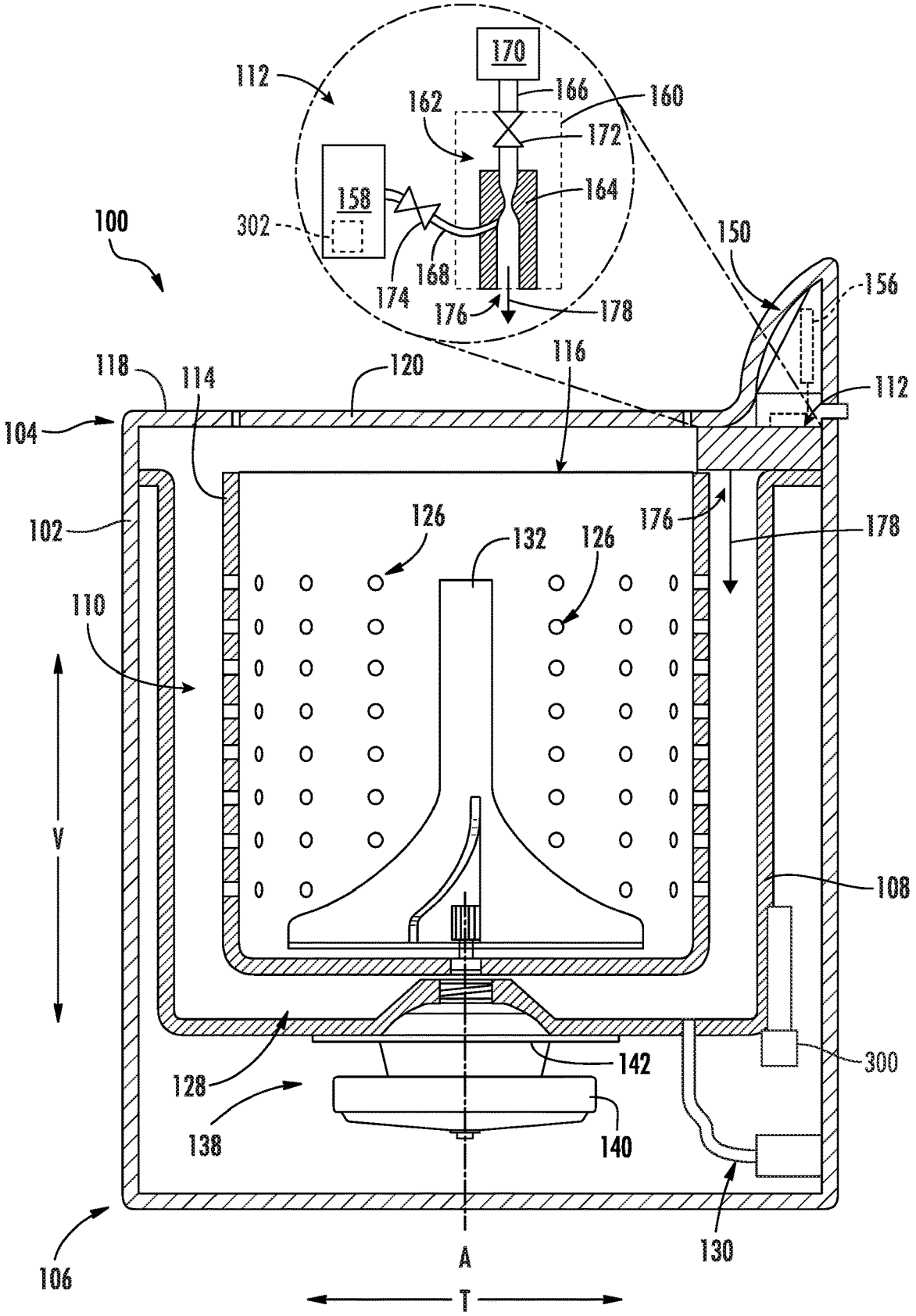
FIG. 3 provides a side cross-sectional view of the exemplary washing machine appliance of FIG. 1.

Turning now to the figures, FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent or other fluid additives via primary dispenser 112. One or more valves can be controlled by washing machine appliance 100 to provide for filling wash tub 108 and wash basket 114 to the appropriate level for the amount of articles being washed or rinsed. By way of example for a wash mode, once wash basket 114 is properly filled with fluid, the contents of wash basket 114 can be agitated (e.g., with agitation element 132 as discussed previously) for washing of laundry items in wash basket 114.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, or other additives, while the wash fluid for a rinse cycle may be water only.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive. Optionally, a level detector 302 (e.g., float sensor, conductivity sensor, pressure sensor, reed switch, etc.) configured to detect a volume of liquid within the bulk reservoir 158 may be provided. The level detector 302 may be in operative communication with (i.e., communicatively coupled to) the controller 156. Thus, controller 156 may be configured to detect a level of wash additive within the bulk reservoir (e.g., as one or more discrete levels or as a variable volumetric value).

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash chamber 108. In this regard, discharge nozzle 176 may be positioned above wash tub proximate a rear of opening 116 defined through top panel 118. Dispensing assembly 112 may be regulated by controller 156 to discharge wash fluid 178 through discharge nozzle 176 at the desired flow rates, volumes, or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of tub 108 for detecting the weight of wash tub 108, which controller 156 may use to determine a volume of water in wash chamber 110 and a subwasher load weight.

In some embodiments, appliance 100 includes a water hardness sensor 300. For instance, a water hardness sensor 300 may be mounted on tub 108—or in fluid communication therewith. As shown, water hardness sensor 300 may be disposed at a bottom portion of tub 108. Generally, water sensor 300 is configured to detected conductivity of water (e.g., collected within wash tub 108), as would be understood. The detected conductivity may be correlated to a hardness level value (e.g., stored within a predetermined reference table on controller 156). Optionally, the conductivity may be further correlated to water temperature (e.g., via a predetermined reference table, formula, chart, graph, etc.). The water temperature may be detected, for instance, with a suitable temperature sensor (e.g., thermistor or thermocouple) incorporated with water hardness sensor 300 or mounted elsewhere on or in communication with appliance 100.

After wash tub 108 is filled and the agitation phase of the wash cycle is completed, wash basket 114 can be drained, e.g., by drain pump assembly 138. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 138 may operate to discharge wash fluid from wash tub 108, e.g., to an external drain. After articles disposed in wash basket 114 are cleaned or washed, the user can remove the articles from wash basket 114, e.g., by reaching into wash basket 114 through opening 116.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide or receive communications, information, data, or commands from a user. In this regard, external device 192 may be, for example, a personal phone, a smartphone, a tablet, a laptop or personal computer, a wearable device, a smart home system, or another mobile or remote device.

In some embodiments, remote user device 192 includes a camera or camera module 180. Camera 180 may be any type of device suitable for capturing a two-dimensional picture or image. As an example, camera 180 may be a video camera or a digital camera with an electronic image sensor [e.g., a charge coupled device (CCD) or a CMOS sensor]. When assembled, camera 180 is generally mounted or fixed to a body of remote user device 192 and is communicatively coupled to (e.g., in electric or wireless communication with) a controller 198 of the remote user device 192 such that the controller 156 (or a processor of a remote server 196) may receive a signal from camera 180 corresponding to the image captured by camera 180.

Generally, external device 192 may include a controller 198 (e.g., including one or more suitable processing devices, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. Controller 198 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 198 or may be included onboard within such processor. In addition, these memory devices can store information or data accessible by the one or more processors of the controller 198, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 198 may be operable to execute programming instructions or micro-control code associated with operation of or engagement with washing machine appliance 100. In this regard, the instructions may be software or any set of instructions that when executed by the processing device, cause the processing device to perform operations, such as running one or more software applications, displaying or directing a user interface, receiving user input, processing user input, etc. Moreover, it should be noted that controller 198 as disclosed herein is capable of and may be operable to perform one or more methods, method steps, or portions of methods of appliance operation. For example, in some embodiments, these methods may be embodied in programming instructions stored in the memory and executed by controller 198.

The memory devices of controller 198 may also store data that can be retrieved, manipulated, created, or stored by the one or more processors or portions of controller 156. The data can include, for instance, data to facilitate performance of methods described herein. store data that can be retrieved, manipulated, created, or stored by the one or more processors or portions of controller 198. The data can include, for instance, data to facilitate performance of methods described herein.

Figure 4:
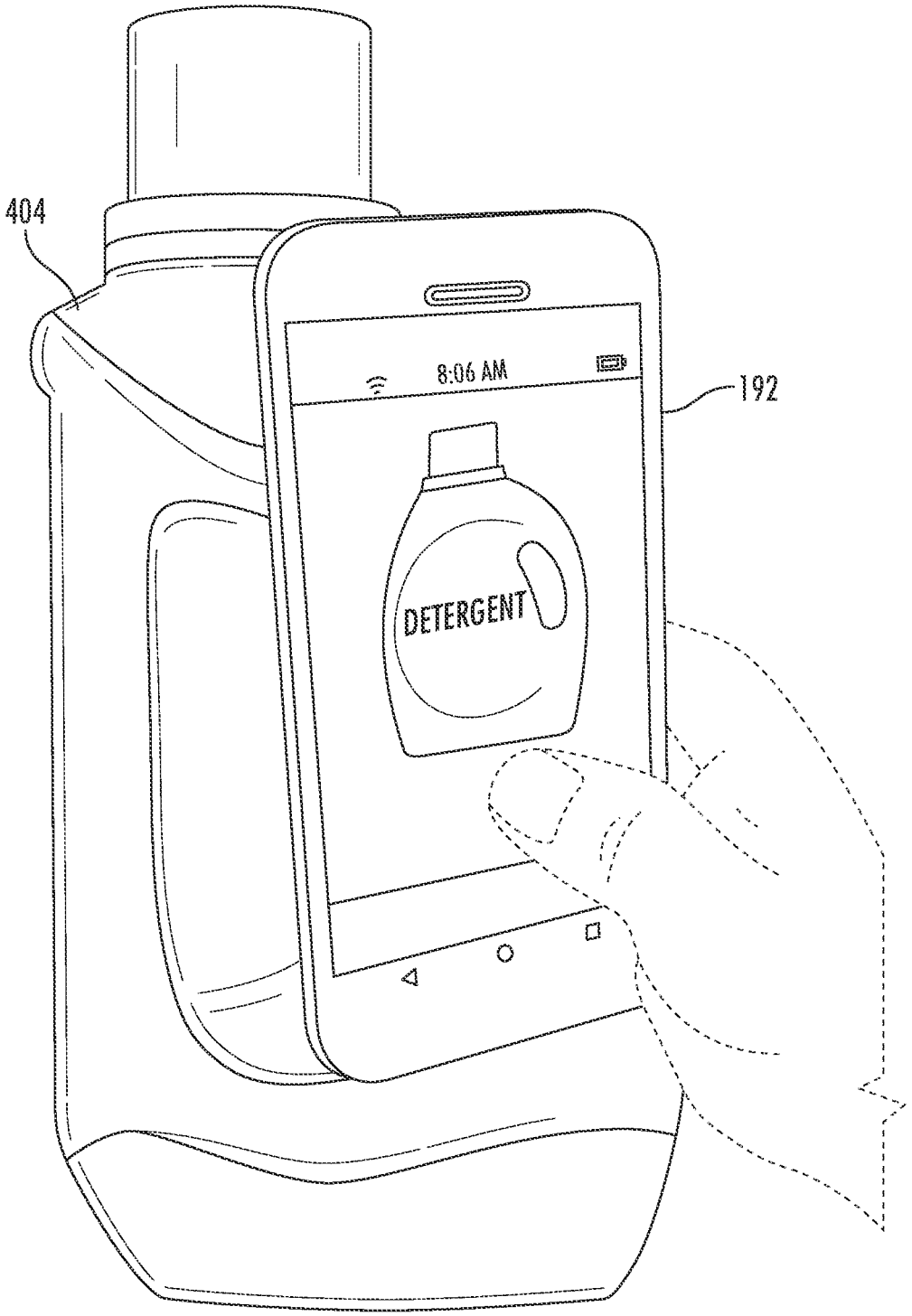
FIG. 4 provides a perspective view illustrating steps of identifying a wash additive according to exemplary embodiments of the present disclosure.

As an example, and turning briefly to FIG. 4, the data may include identifying information to identify or detect a wash additive from one or more images. For instance, a remote device 192 may be used to capture an image of an additive container 404 or container in which the wash additive loaded or to be loaded within washing machine appliance 100 is stowed. Thus, a user may present the container proximate remote device 192 (or another suitable image capture device) so that camera 180 (FIG. 1) may capture the image of the container 404. Based on the captured image of the container, a controller (e.g., 156, 188, or a processor on remote server 196) can identify the wash additive, e.g., by using image recognition module or software. Additionally or alternatively, remote device 192 may capture the image of the wash additive itself. Based on the captured image of the wash additive, a controller (e.g., 156, 188, or a processor on remote server 196) can identify the wash additive, e.g., by using image recognition module or software Returning to FIG. 1, a remote server 196 may be in communication with (i.e., communicatively coupled to) washing machine appliance 100 or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller(s) 156, 198 according to exemplary embodiments have been presented, exemplary methods (e.g., methods 500 and 600) of operating a washing machine appliance will be described. Although the discussion below refers to the exemplary methods 500 and 600 of operating washing machine appliance 100, one skilled in the art will appreciate that the exemplary methods 500 and 600 are applicable to the operation of a variety of other washing machine appliances, such as vertical axis washing machine appliances. In exemplary embodiments, the various method steps as disclosed herein may be performed (e.g., in whole or part) by controller 156, controller 198, or another, separate controller (e.g., on remote server 196).

Figure 5:
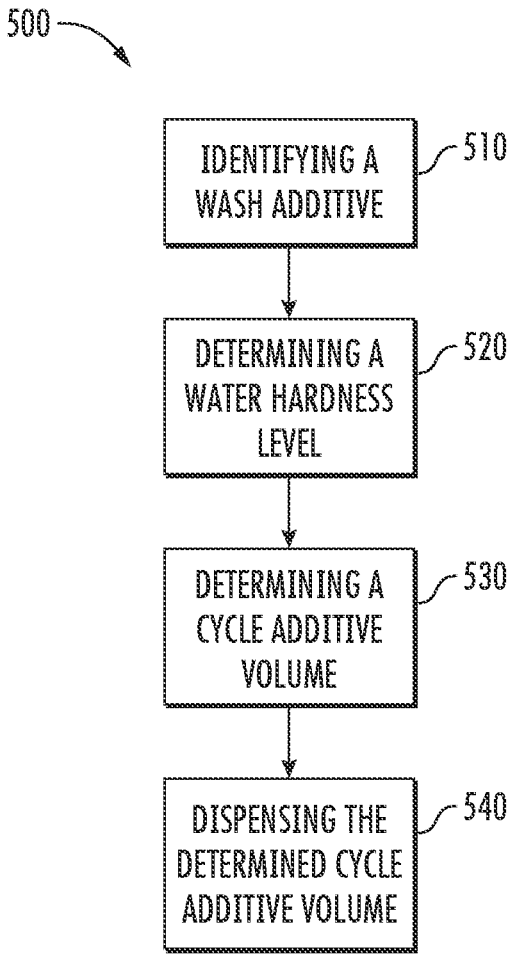
FIG. 5 provides a flow chart illustrating a method of operating a washing machine appliance according to exemplary embodiments of the present disclosure.
Figure 6:
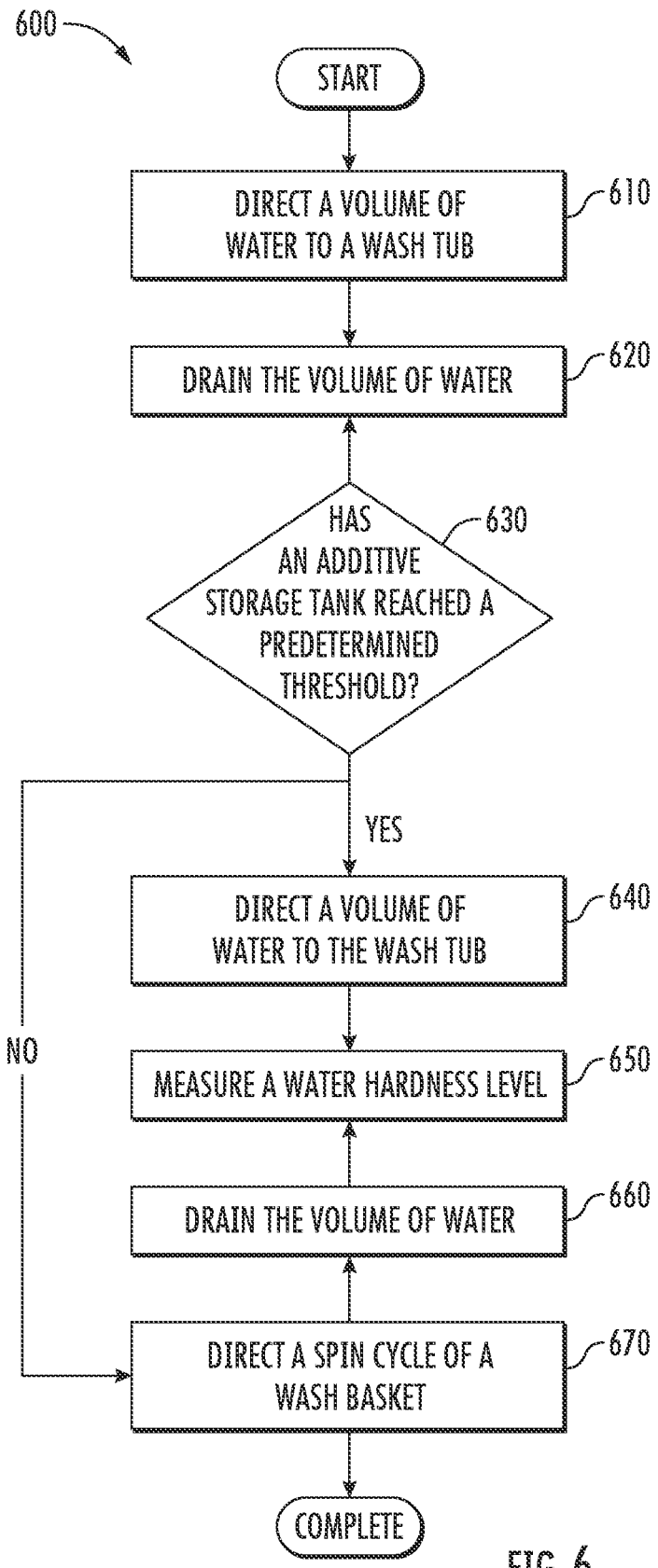
FIG. 6 provides a flow chart illustrating a method of operating a washing machine appliance according to exemplary embodiments of the present disclosure.

FIGS. 5 and 6 depict steps performed in a particular order for purpose of illustration and discussion. Those of ordinary skill in the art, using the disclosures provided herein, will understand that (except as otherwise indicated) methods 500 and 600 are not mutually exclusive. Moreover, the steps of the methods 500 and 600 can be modified, adapted, rearranged, omitted, interchanged, or expanded in various ways without deviating from the scope of the present disclosure.

Advantageously, methods in accordance with the present disclosure may permit effective or efficient dispensing of a wash additive (e.g., without requiring direct user knowledge or calculations). Additionally or alternatively, methods or dispensing may advantageously account for differences in wash additives or water hardness.

Turning especially to FIG. 5, at 510, the method 500 includes identifying a wash additive provided to the washing machine appliance. For instance, the wash additive may be manually identified by a user selecting the particular wash additive from a known list. Alternatively, the wash additive may be automatically identified from a captured image (e.g., as described below).

In some embodiments, 510 includes obtaining one or more images of a wash additive (e.g., container thereof) from a camera assembly, such as may be provided on a remote device (i.e., external device). For instance, the camera of the external device may be aimed at the container of a wash additive, as illustrated in FIG. 4. In turn, such images may include or capture a two-dimensional image of an additive container.

It should be appreciated that obtaining the images may include obtaining more than one image, a series of frames, a video, or any other suitable visual representation of the wash additive using the camera assembly. Thus, 510 may include receiving a video signal from the camera assembly. Separate from or in addition to the video signal, the images obtained by the camera assembly may vary in number, frequency, angle, resolution, detail, etc. in order to improve the clarity of the load of clothes. In addition, the obtained images may also be cropped in any suitable manner for improved focus on desired portions of the load of clothes.

In optional embodiments, the obtained images can be presented or displayed as a real-time feed of the camera assembly at the remote device (e.g., according to the received video signal). For instant, a constant or regularly refreshing set of live images from the camera assembly may be presented on the monitor or screen of the remote device. Thus, a user viewing the remote device may be able to see the field of view being captured by the camera assembly (e.g., without having to repeatedly freeze the frame or provide any active input by a user on the remote device).

The one or more images may be obtained using the camera assembly at any suitable time prior to initiating a wash cycle.

In certain embodiments, 510 further includes analyzing the obtained image(s) to identify the wash additive. As is understood, recognizing or identifying such wash additives (e.g., based on an image of a container), may be performed by one or more image processing techniques or algorithms (e.g., executed at the controller of the remote device, remote server, or appliance). According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the controller of the remote device, remote server, or appliance based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

At 520, the method 500 includes determining a water hardness level of water provided to the washing machine appliance. For instance, during the wash cycle or operation, a predetermined water hardness level may be referenced (e.g., within the memory or storage of a controller). The predetermined hardness level may be obtained, for instance, during an earlier or previous washing operation in which the local water hardness is measured, estimated, or otherwise identified.

In some embodiments, the water hardness level may be measured as part of the current washing operation. For instance, 520 may include directing a volume (e.g., set volume or amount) of water to the wash tub (e.g., while restricting the flow of any wash additives). The volume of wash water during 520 may be clean or otherwise free of any additives. Once the volume of water of water is directed or dispensed to the tub (i.e., following directing the volume of water to the wash tub), 520 may further include measuring the water hardness level of the volume of water (e.g., at the water hardness sensor on, within, or otherwise in fluid communication with the wash tub). For instance, the conductivity of the volume of water within the wash tub may be detected. Additionally or alternatively, the temperature of the volume of water may be detected. From the detected conductivity or temperature, the water hardness level may then be determined (e.g., according to a predetermined reference table, formula, chart, graph, etc.).

In certain embodiments, the water hardness level is measured in response to detecting a certain amount, volume, or level of wash additive within the additive storage tank. For instance, during the washing operation, it may be detected that wash additive within an additive storage tank (i.e., bulk reservoir) has reached a predetermined threshold. The predetermined threshold may be a lower limit or an upper limit. As an example, the predetermined threshold may be a lower limit (e.g., substantially empty). Thus, the water hardness level may be measured in response to wash additive within the additive storage tank being detected as less than or equal to the lower limit. As an additional or alternative example, the predetermined threshold may be an upper limit (e.g., substantially filled or a maximum fill level). Thus, the water hardness level may be measured in response to wash additive within the additive storage tank being detected as greater than or equal to the upper limit, such as when the additive storage tank is refilled.

At 530, the method 500 includes determining a cycle additive volume based on the identified wash additive or the determined water hardness level. In other words, from the identified wash additive or the determined water hardness level, the amount or volume of wash additive to be dispensed may be determined.

In some embodiments, the identified wash additive and the determined water hardness level are both used. As an example, 530 may include determining a default volume value based on the identified wash additive. Optionally, a programmed table may be provided (e.g., within one or more controller) in which a plurality of wash additives (e.g., types of detergent) are listed with corresponding default volumes and load sizes. In other words, for multiple different load sizes, a discrete default volume may be provided for each of the plurality of wash additives. Thus, the identified wash additive may be referenced (e.g., along with a set load size) to find the corresponding default volume of wash additive to be dispensed.

In certain embodiments, 530 further includes modifying the default value based on the determined hardness level. As an example, the default value may be modified (e.g., multiplied or divided) by a hardness factor. Such a hardness factor may be determined according to the determined hardness level. Optionally, a programmed table may be provided (e.g., within one or more controller) in which a plurality of water hardness levels (e.g., ranges of water hardness values) are listed with corresponding hardness factors. In other words, for multiple different hardness levels, a discrete hardness factor may be provided. Thus, the default value may be modified by the determined hardness factor to calculate an updated volume (e.g., to be used as or as part of the cycle additive volume).

Although described primarily in the context of liquid volumes, it is understood that the above determinations or values may be determined in the context of estimated volumes or activation times (e.g., numbers of pulses) of the dispensing assembly. Thus, a set activation time or number of pulses may be known (e.g., from past or empirical determinations) to dispense a correlated or set volume of wash additive.

At 540, the method 500 includes dispensing the determined cycle additive volume within the wash tub. In other words, the dispensing assembly may be operated (e.g., as described above) to dispense the determined cycle additive volume. For example, continuing the example from above, the dispensing assembly may be used to provide flow of wash fluid into wash tub to facilitate various operating phases or cycles of washing machine appliance. More particularly, the dispensing assembly may dispense wash fluid that includes a mixture of water and the determined cycle additive volume (e.g., with or without other additives) during a wash phase or cycle.

Further rinse, agitation, or drain cycles may further be provided, as would be understood, until the washing operation is finished.

Turning now to FIG. 6, at 610, the method 600 includes directing a volume of water to the wash tub. For instance, 610 may include operating a dispensing assembly to discharge a flow of wash fluid into a wash tub of a washing machine appliance. For example, continuing the example from above, the dispensing assembly may be used to provide flow of wash fluid into the wash tub to facilitate various operating phases or cycles of washing machine appliance. More particularly, the dispensing assembly may dispense wash fluid that includes a mixture of water, detergent, or other additives during a wash phase or cycle. By contrast, during a rinse phase or cycle, the dispensing assembly may dispense wash fluid that contains only fresh water.

At 620, the method 600 includes draining the volume of wash water. For instance, as would be understood, the drain pump assembly may operate to discharge wash fluid from the wash tub, e.g., to an external drain.

Is noted that although a single 610 and 620 are represented, certain embodiments may include multiple fill-drain steps (e.g., repeating 610 and 620) before the method proceeds to 630.

At 630, the method 600 includes evaluating or detecting the amount, volume, or level of wash additive within the additive storage tank. For instance, during the washing operation, it may be determined whether wash additive within an additive storage tank (i.e., bulk reservoir) has reached a predetermined threshold. The predetermined threshold may be a lower limit or an upper limit. As an example, the predetermined threshold may be a lower limit (e.g., substantially empty). Thus, it may be detected that wash additive within the additive storage tank is less than or equal to the lower limit. As an additional or alternative example, the predetermined threshold may be an upper limit (e.g., substantially filled or a maximum fill level). Thus, it may be detected that wash additive within the additive storage tank is greater than or equal to the upper limit, such as when the additive storage tank is refilled.

If the predetermined threshold has not reached the predetermined threshold, the method 600 may proceed directly to 670. By contrast, if the predetermined threshold has been reached, the method 600 may proceed to 640.

At 640, the method 600 includes directing a volume (e.g., set volume or amount) of water to the wash tub (e.g., while restricting the flow of any wash additives). The volume of wash water during 640 may be clean or otherwise free of any additives.

At 650, the method 600 includes measuring a water hardness level of the volume of water from 640 (e.g., at the water hardness sensor on, within, or otherwise in fluid communication with the wash tub). For instance, the conductivity of the volume of water within the wash tub may be detected. Additionally or alternatively, the temperature of the volume of water may be detected. From the detected conductivity or temperature, the water hardness level may then be determined (e.g., according to a predetermined reference table, formula, chart, graph, etc.). The measured water hardness level may be stored (e.g., within a controller). In some embodiments, 650 is in response to 640.

At 660, the method 600 includes draining the volume of wash water. For instance, as would be understood, the drain pump assembly may operate to discharge wash fluid from the wash tub, e.g., to an external drain. Generally, 660 may follow 650 or be in response to the same.

At 670, the method 600 includes directing a spin cycle may be applied in order to wring wash fluid from the articles being washed. As described above, a spin cycle, the wash basket is rotated at relatively high speeds to help wring fluid from the laundry articles. During the spin cycle, the drain pump assembly may continue to operate to discharge wash fluid from the wash tub, e.g., to an external drain.

Following 670, a washing operation may be continued, such as to dispense a cycle additive volume that is determined based on the measured hardness water level or identified wash additive (e.g., as described above). Alternatively, the method 600 may halt the washing operation while storing the measured water hardness level (e.g., for use during a subsequent washing operation).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a wash tub positioned within a cabinet;
- a wash basket rotatably mounted within the wash tub and defining a wash chamber configured for receiving a load of clothes;
- a dispensing assembly configured to selectively dispense a flow of wash fluid through a discharge nozzle into the wash tub;
- a water hardness sensor mounted in fluid communication with the wash tub;
- a camera assembly spaced apart from the wash tub; and
- a controller communicatively coupled to the water hardness sensor and the camera assembly, the controller being configured to direct a washing operation, the washing operation comprising
  - identifying, based on visual data captured by the camera assembly, a wash additive provided to the washing machine appliance,
  - determining, based on data measured by the water hardness sensor, a water hardness level of water provided to the washing machine appliance,
  - determining a cycle additive volume based on a default volume associated with the identified wash additive and modifying the default volume based on the determined water hardness level, and
  - dispensing the determined cycle additive volume within the wash tub.

2. The washing machine appliance of claim 1, wherein identifying the wash additive comprises
- obtaining one or more images of a container in which the wash additive is stowed or the wash additive from the camera assembly; and
- analyzing, using an image processing algorithm, the image to identify the wash additive.

3. The washing machine appliance of claim 1, wherein the washing operation further comprises directing a volume of water to the wash tub, wherein determining the water hardness level comprises measuring the water hardness level at the water hardness sensor following directing the volume of water to the wash tub.

4. The washing machine appliance of claim 3, wherein measuring the water hardness level comprises detecting conductivity of the volume of water within the wash tub.

5. The washing machine appliance of claim 4, wherein the washing operation further comprises
- detecting wash additive within an additive storage tank has reached a predetermined threshold,
- wherein measuring the water hardness level is in response to detecting wash additive within the additive storage tank has reached the predetermined threshold.

6. The washing machine appliance of claim 1, wherein determining a default volume value comprises referencing a predetermined default value corresponding to the identified wash additive.

7. The washing machine appliance of claim 1, wherein determining the cycle additive volume further comprises determining a hardness factor according to the determined hardness level, and modifying the default volume value using the determined hardness factor.

8. A washing machine appliance, comprising:
- a wash tub positioned within a cabinet;
- a wash basket rotatably mounted within the wash tub and defining a wash chamber configured for receiving a load of clothes;
- a dispensing assembly configured to selectively dispense a flow of wash fluid through a discharge nozzle into the wash tub;
- a water hardness sensor mounted in fluid communication with the wash tub;
- a camera assembly spaced apart from the wash tub; and
- a controller communicatively coupled to the water hardness sensor and the camera assembly, the controller being configured to direct a washing operation, the washing operation comprising
  - identifying, based on visual data captured by the camera assembly, a wash additive provided to the washing machine appliance,
  - determining a water hardness level of water provided to the washing machine appliance,
  - determining a cycle additive volume based on a default volume associated with the identified wash additive and modifying the default volume based on the determined water hardness level, and
  - dispensing the determined cycle additive volume within the wash tub, wherein identifying the wash additive comprises obtaining one or more images of a container in which the wash additive is stowed or the wash additive from the camera assembly, and analyzing, using an image processing algorithm, the image to identify the wash additive, and wherein determining the water hardness level comprises referencing a predetermined hardness level.

9. The washing machine appliance of claim 8, wherein determining a default volume value comprises referencing a predetermined default value corresponding to the identified wash additive.

10. The washing machine appliance of claim 9, wherein determining the cycle additive volume further comprises determining a hardness factor according to the determined hardness level, and modifying the default volume value using the determined hardness factor.

* * * * *